US012497725B2

(12) United States Patent
Lee et al.

(10) Patent No.: US 12,497,725 B2
(45) Date of Patent: Dec. 16, 2025

(54) WASHING MACHINE

(71) Applicant: SAMSUNG ELECTRONICS CO., LTD., Suwon-si (KR)

(72) Inventors: Doyun Lee, Suwon-si (KR); Geonhui Jo, Suwon-si (KR); Bongjin Ko, Suwon-si (KR); Byeongwoo Kim, Suwon-si (KR); Yonggyun Yim, Suwon-si (KR); Kwangmin Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 142 days.

(21) Appl. No.: 18/385,739

(22) Filed: Oct. 31, 2023

(65) Prior Publication Data

US 2024/0229331 A1 Jul. 11, 2024

Related U.S. Application Data

(63) Continuation of application No. PCT/KR2023/015535, filed on Oct. 10, 2023.

(30) Foreign Application Priority Data

Jan. 5, 2023 (KR) ..... 10-2023-0001891

(51) Int. Cl.
*D06F 39/02* (2006.01)
*D06F 34/28* (2020.01)

(52) U.S. Cl.
CPC ..... *D06F 39/02* (2013.01); *D06F 34/28* (2020.02)

(58) Field of Classification Search
CPC ..... D06F 39/02
See application file for complete search history.

(56) References Cited

U.S. PATENT DOCUMENTS

| | | | |
|---|---|---|---|
| 10,036,116 | B2 | 7/2018 | Jo et al. |
| 2018/0363220 | A1 | 12/2018 | Gim |
| 2021/0017691 | A1 | 1/2021 | Jo et al. |

FOREIGN PATENT DOCUMENTS

| | | | |
|---|---|---|---|
| CN | 2425110 | Y | 3/2001 |
| CN | 1683702 | A | 10/2005 |

(Continued)

OTHER PUBLICATIONS

International Search Report issued on Jan. 11, 2024 in International Patent Application No. PCT/KR2023/015535.

(Continued)

*Primary Examiner* — Jason Y Ko
(74) *Attorney, Agent, or Firm* — STAAS & HALSEY LLP

(57) ABSTRACT

A washing machine including a housing, a control panel having an opening and a fixing protrusion, and a detergent supply device configured to be drawn into and out of the opening. The detergent supply device including a body to accommodate a detergent therein, and a handle rotatably connected to the main body and including a locking protrusion. The detergent supply device and the handle are configured to have a locked state in which the detergent supply device is drawn into the washing machine, the locking protrusion is positioned closer to the body than the fixing protrusion, and forward movement of the detergent supply device is restricted by the locking protrusion contacting the fixing protrusion, and, the handle is rotatable to move the locking protrusion thereby releasing the detergent supply device from the locked state to an open state in which forward movement of the detergent supply device through the opening is not restricted.

20 Claims, 20 Drawing Sheets

(56) References Cited

FOREIGN PATENT DOCUMENTS

| | | | |
|---|---|---|---|
| CN | 100519897 | C | 7/2009 |
| CN | 109972355 | B | 11/2021 |
| CN | 114197975 | A | 3/2022 |
| CN | 217488447 | U | 9/2022 |
| JP | 2004-214026 | | 7/2024 |
| KR | 1997-0006351 | | 6/1997 |
| KR | 20-2000-0013788 | U | 7/2000 |
| KR | 10-0556791 | B1 | 3/2006 |
| KR | 10-2007-0063998 | | 6/2007 |
| KR | 10-2008-0104641 | A | 12/2008 |
| KR | 10-1176134 | | 8/2012 |
| KR | 10-2018-0090003 | A | 8/2018 |
| KR | 10-2018-0136099 | | 12/2018 |
| KR | 10-2191908 | B1 | 12/2020 |
| KR | 10-2281339 | | 7/2021 |

OTHER PUBLICATIONS

Written Opinion issued on Jan. 11, 2024 in International Patent Application No. PCT/KR2023/015535.

WASHING MACHINE

CROSS-REFERENCE TO RELATED APPLICATION

This application is a continuation application of International Application No. PCT/KR2023/015535 designating the United States, filed on Oct. 10, 2023, in the Korean Intellectual Property Receiving Office, which claims priority from Korean Patent Application No. 10-2023-0001891 filed on Jan. 5, 2023, in the Korean Intellectual Property Office, the disclosure of which is hereby incorporated by reference herein in their entireties.

BACKGROUND

Field

Embodiments of the disclosure may provide a washing machine including a detergent supply device with a cover of a rotating structure.

Description of Related Art

A washing machine is a home appliance for washing clothing, towels, bedding, and the like. Types of washing machines include a drum-type washing machine that washes laundry by repeatedly lifting and dropping the laundry while rotating a rotating tub, and an electric pulsator-type washing machine that washes laundry using water stream generated by a pulsator when the rotating tub is rotating.

The washing machine is equipped with a detergent supply device that allows detergent to be evenly mixed with washing water and supplied to the rotating tub. The detergent supply device may be provided to be drawn out by a user to the outside of the washing machine, and may be arranged on a control panel making up a portion of a front appearance of the washing machine.

Typically, a front face of the detergent supply is provided with a handle capable of being gripped by a user to draw out the detergent supply device to the outside of the washing machine.

SUMMARY

Various embodiments of the disclosure may provide a washing machine having a structure in which a grip portion of a detergent supply device is not exposed to the outside, while the detergent supply device is inserted into the washing machine, According to an embodiment of the disclosure, a washing machine may comprise a housing. The washing machine may comprise a control panel disposed on a front surface of the housing and may include an opening and a fixing protrusion. The washing machine may comprise a detergent supply device configured to be drawn into and out of the washing machine through the opening. The detergent supply device may include a body configured to accommodate a detergent therein. The detergent supply device may include a handle rotatably connected to the main body and including a locking protrusion. The detergent supply device and the handle may be configured so that the detergent supply device has a locked state in which the detergent supply device is drawn into the washing machine, the locking protrusion may be disposed at a position closer to the body than the fixing protrusion may be to the body, and forward movement of the detergent supply device through the opening due to vibrations generated during operation of the washing machine may be restricted by the locking protrusion coming into contact with the fixing protrusion, and, when the detergent supply device is in the locked state, the handle may be rotatable to move the locking protrusion and thereby release the detergent supply device from the locked state so that the detergent supply device is in an open state in which forward movement of the detergent supply device through the opening may not be restricted by contact between the locking protrusion and the fixing protrusion.

According to an embodiment, the handle may include a front surface, a back surface opposite the front surface and a grip portion on one side of the back surface. Rotation of the handle may move the grip portion between being concealed within the control panel in the locked state and being exposed to an outside of the control panel in the open state.

According to an embodiment, the grip portion may be recessed from the one side to an opposing side.

According to an embodiment, the front surface of the handle may be aligned with the front surface of the control panel when the detergent supply device is in the locked state.

According to an embodiment, while no external force is applied to the handle, the detergent supply device may be maintained in the locked state.

According to an embodiment, the handle may be rotatable such that, in response to applying an external force to the handle, the locking protrusion may be moved and may change the detergent supply device from the locked state to the open state, or from the open state to the locked state.

According to an embodiment, the washing machine may further comprise a detergent supply device guide extending into the opening from a periphery of the opening. The washing machine may comprise a pair of fixing protrusions protruding laterally an inner surface of the detergent supply device guide so that the fixing protrusions of the pair of fixing protrusions face each other.

According to an embodiment, the fixing protrusion may include a first vertical surface facing the locking protrusion of the handle when the detergent supply device is in the locked state, and a first inclined surface connected to the first vertical surface and having a slope ascending toward a front side of the fixing protrusion.

According to an embodiment, the washing machine may further comprise a pair of locking protrusions. The pair of locking protrusions may be configured to protrude in opposite directions to each other from both sides of the handle.

According to an embodiment, the locking protrusion may include a second vertical surface facing the fixing protrusion of the control panel when the detergent supply device is in the locked state, and a second inclined surface connected to the second vertical surface and having a slope descending toward a rear side of the locking protrusion.

According to an embodiment, the detergent supply device may have a hinged structure which rotatably connects the handle to the body.

According to an embodiment, the detergent supply device may have a plurality of link bars connecting the body and the handle such that the handle is rotatable about two different axes provided in the body.

According to an embodiment, the detergent supply device may have a slide structure to guide rotation of the handle through two pairs of holes providing different paths provided in the body.

According to an embodiment, the detergent supply device may include an elastic member arranged to surround a rotation axis of the handle.

According to an embodiment, the detergent supply device may include an elastic member connecting the body with at least one of an upper portion of the handle and a lower portion of the handle.

According to an embodiment of the disclosure, a washing machine may comprise a housing. The washing machine may comprise a control panel on a front surface of the housing and having an opening. The washing machine may comprise a detergent supply device configured to be drawn into and out of the washing machine through the opening. The detergent supply device may include a body to accommodate a detergent therein. The detergent supply device may include a handle having a front surface alignable with a front side of the housing, a back surface opposite the front surface and a grip portion on one side of the back surface that is concealed from an outside of the control panel when the front surface of the handle is aligned with the front side of the housing. The handle may be rotatable to no longer be aligned with the front side of the housing and to move the grip portion to no longer be concealed from the outside when the handle is not aligned with the front side of the housing.

According to an embodiment, the handle may include a first end including the grip portion, and a second end opposite the first end. The handle may be configured to rotate such that the second end approaches the body and the first end moves away from the body.

According to various embodiments of the disclosure, a grip portion for drawing out the detergent supply device to the outside of the washing machine may be provided on an inner side of a cover of the detergent supply device, so that the grip portion is not exposed to the exterior while the detergent supply device is inserted into the washing machine. Thus, the detergent supply device can form an integral continuous surface together with the control panel, creating a sense of unity in its aesthetic appearance.

Effects of the disclosure are not limited to the foregoing, and other unmentioned effects would be apparent to one of ordinary skill in the art from the following description. In other words, unintended effects in practicing embodiments of the disclosure may also be derived by one of ordinary skill in the art from the embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same or similar reference denotations may be used to refer to the same or similar elements throughout the specification and the drawings.

DETAILED DESCRIPTION

Figure 1:
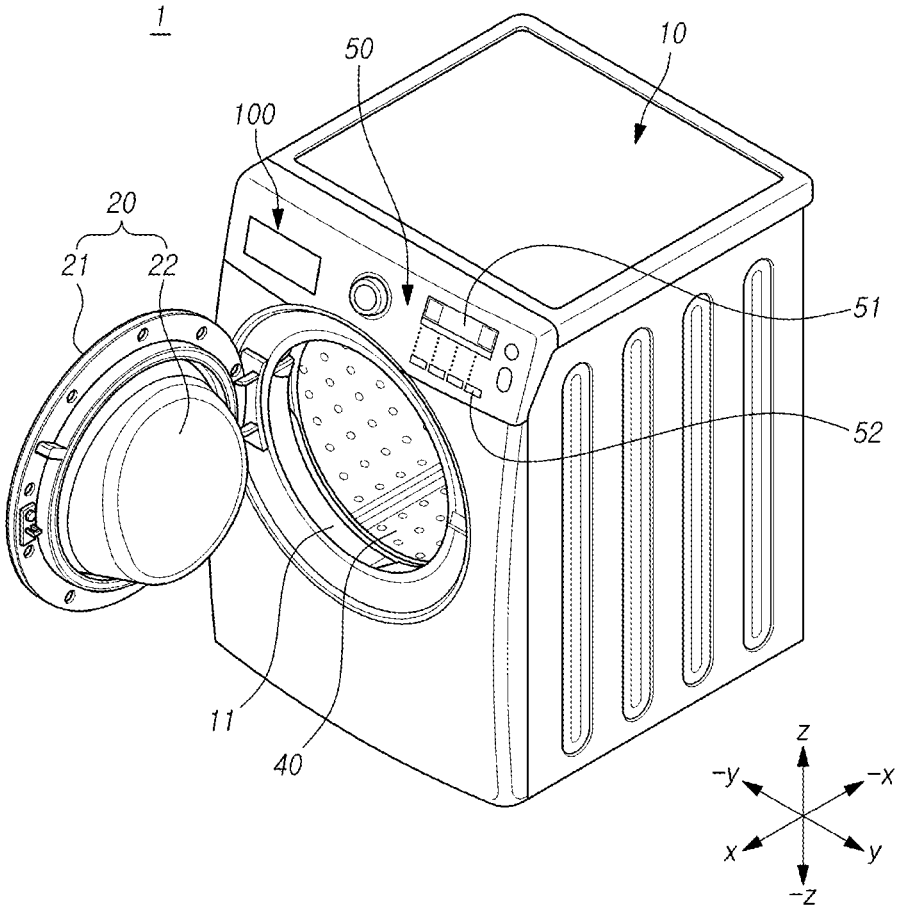
FIG. 1 is a perspective view illustrating an external appearance of a washing machine according to an embodiment.

Embodiments of the disclosure are now described with reference to the accompanying drawings in such a detailed manner as to be easily practiced by one of ordinary skill in the art. However, the disclosure may be implemented in other various forms and is not limited to the embodiments set forth herein. The same or similar reference denotations may be used to refer to the same or similar elements throughout the specification and the drawings. Further, for clarity and brevity, no description is made of well-known functions and configurations in the drawings and relevant descriptions.

Figure 2:
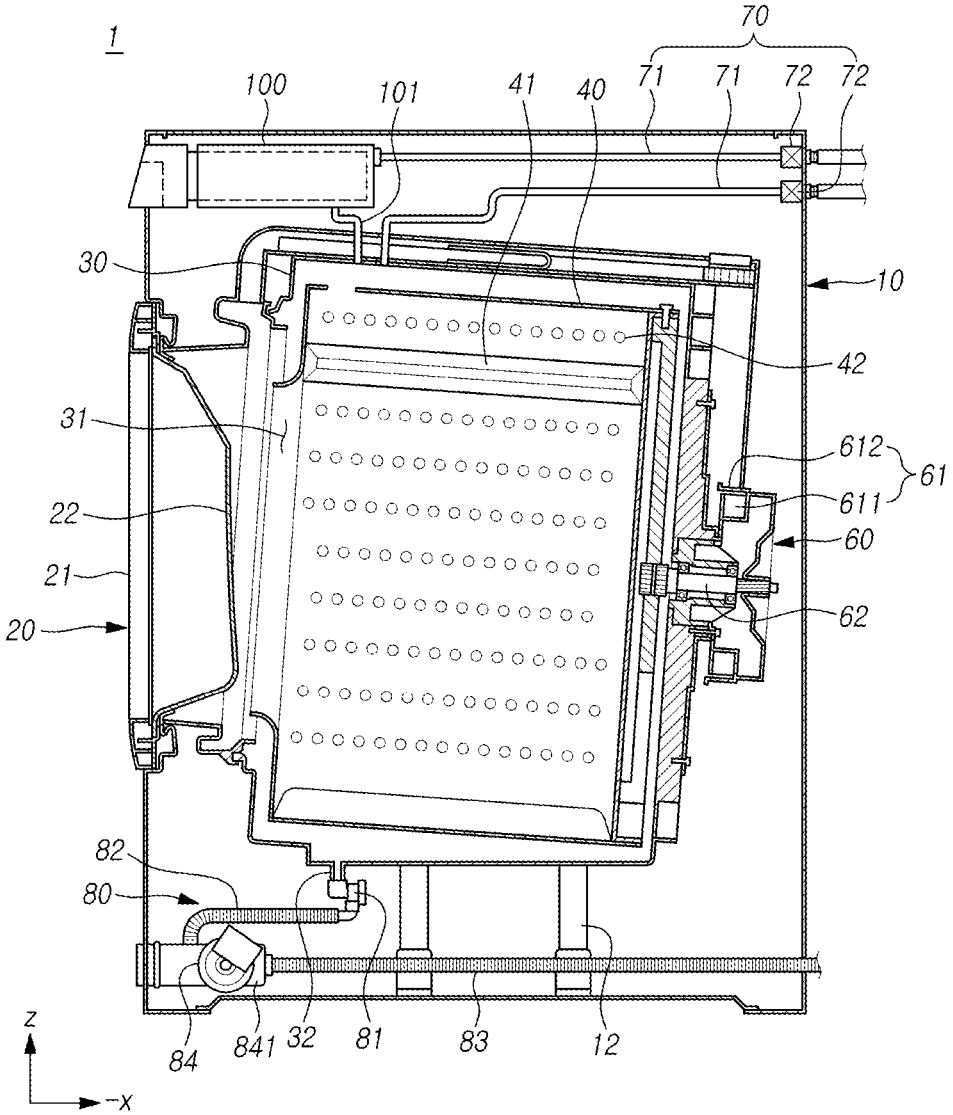
FIG. 2 is a side cross-sectional view of a washing machine according to an embodiment.

FIG. 1 is a perspective view illustrating an external appearance of a washing machine according to an embodiment. FIG. 2 is a side cross-sectional view of a washing machine according to an embodiment.

In an example, a washing machine 1 may include a housing 10 accommodating various components therein. The housing 10 may have a substantially hexahedral shape. The housing 10 may have an opening 11 formed in one side. At least two of respective faces of the housing 10 may be integrally formed. Each of the faces of the housing 10 may be manufactured in a separate manner and assembled together. The housing 10 may be, for example, press-molded from a sheet metal material or injection-molded from a resin material.

In an example, a door 20 for opening and closing the opening 11 may be provided in a portion of the housing 10 corresponding to the opening 11. The door 20 may be pivotably coupled to a hinge fixed to one surface of the housing 10. The door 20 may be arranged to be at least partially transparent or translucent, for example, so that its interior is visible from the outside. A user may open and close the door 20 to insert laundry into a drum 40 located inside the housing 10 or to draw out laundry from the drum 40. The door 20 may be locked, for example, by a locking mechanism (not shown) to prevent it from being opened unintentionally while the washing machine 1 is in operation. In an example, the door 20 may include a door frame 21 and a glass member 22. The glass member 22 may be formed of, for example, a transparent reinforced glass material to allow viewing of the interior of the housing 10, and the present disclosure is not limited thereto.

In an example, the washing machine 1 may include a tub 30 fixedly disposed inside the housing 10. The tub 30 may have a substantially cylindrical shape with one side open. The front of the tub 30 may be provided with a tub opening 31 in a position corresponding to the opening in the housing 10. The tub 30 may hold washing water therein. A drain hole 32 for draining the washing water therethrough may be provided at the bottom of the tub 30. The drain hole 32 may be connected to, for example, a drain unit 80.

In an example, the washing machine 1 may include a damper 12. The damper 12 may be arranged to connect the housing 10 and the tub 30. One side of the damper 12 may be secured to an inner surface of the housing 10 and the other side thereof may be secured to the tub 30. The damper 12 may be arranged to absorb vibration energy that is transmitted to the tub 30 and/or the housing 10 when the drum 40 rotates, thereby damping the vibration.

In an example, the washing machine 1 may include a drum 40 arranged in the inside of the tub 30. The drum 40 may have a substantially cylindrical shape with one side open. A front side of the drum 40 may be provided with the opening 11 of the housing 10 and a drum opening at a position corresponding to the tub opening 31 of the tub 30. The drum 40 may accommodate laundry therein. The drum 40 may receive rotational power from a drive unit 60 to rotate in the tub 30. As the drum 40 rotates in the tub 30, it can perform washing, rinsing, and/or dehydrating.

In an example, the drum 40 may include a lifter 41 and/or a plurality of through holes 42. The lifter 41 may, for example, lift the laundry while the drum 40 is rotating, causing the laundry to rise and fall repeatedly, thereby ensuring that different sides and faces of the laundry are cleaned evenly. The through hole 42 may be, for example, a passageway formed for washing water received within the tub 30 to flow into the interior of the drum 40, or for washing water within the drum 40 to drain to the outside. In an example, the lifter 41 or the through hole 42 may be omitted.

In an example, the washing machine 1 may include a control panel 50 at an upper part of its front panel. In an example, the control panel 50 may be disposed on the front top of the housing 10, as shown in FIG. 1. In an example, the control panel 50 may include a configuration to support interaction between a user and the washing machine 1. In an example, the control panel 50 may include an input unit 51 and a display unit 52. In an example, the control panel 50 may include an opening (indicated by 53 in FIG. 3) for drawing-in and/or drawing-out of a detergent supply device 100, as described later. In an example, the detergent supply device 100 may be disposed in an upper region of the housing 10, and may be drawn out toward the front side of the housing 10 through the opening 53 of the control panel 50, or may be drawn into an interior space of the housing 10.

While FIGS. 1 and 2 illustrate the detergent supply device 100 as being drawn in/out through the opening 53 of the control panel 50, the present disclosure is not limited thereto and the detergent supply device 100 may be arranged to be drawn-in or drawn-out to/from the interior of the washing machine through an opening provided in one surface (e.g., a front) of the housing 10. In this case, a fixing protrusion (indicated by 55 in FIG. 4) to be described later may be provided inside the housing 10. For example, the locking protrusion may be provided onto a separate guide member having a structure similar to a guide member (indicated by 53 in FIG. 4) of the control panel 50 described above, or may be provided on an inner surface of the housing 10.

The input unit 51 may include, for example, any type of user input means for obtaining user inputs for control of the washing machine 1. A user may input, for example, power on/off for the washing machine 1, laundry setting information (e.g., start/stop operation, course selection, time selection, etc.), and the like, via the input unit 51. For example, the input unit 51 may include a tact switch, a push switch, a slide switch, a toggle switch, a micro switch, or a touch switch, but the disclosure is not limited thereto. For example, the input unit 51 may be in the form of a jog shuttle capable of being gripped and rotated by a user. In an example, the input unit 51 may include an infrared sensor. The user may enter the setting information remotely using a remote control, and the setting information may be received via the input unit 51 as an infrared signal. In an example, the input unit 51 may include a microphone. The setting information by a user's voice may be obtained via the microphone.

The display unit 52 may be adapted to display various laundry setting information input from the user and/or operation status information of the washing machine 1. The display unit 52 may include a display panel of various types, such as, e.g., LCD, LED, OLED, QLED, Micro-LED, or the like. For example, the display unit 52 may be implemented as a touch screen with a touch pad on the front surface, and the disclosure is not limited to any particular type of display panel. In an example, the display unit 52 may include any form of audio output means inclusive of a speaker, and may represent the above information as an audible signal via the audio output means. In an example, the display unit 52 may operate to audibly provide the user with information to guide the user's input and/or information related to the operation currently in progress.

In an example, the washing machine 1 may include a drive unit 60 for rotating the drum 40. The drive unit 60 may include a motor 61 and a drive shaft 62 for transmitting a driving force generated by the motor 61 to the drum 40. The motor 61 may include a stationary stator 611 and a rotor 612 that rotates in electromagnetic interaction with the stator 611, thereby converting electrical power into mechanical rotary force. The rotary force generated by the motor 61 may be transmitted to the drum 40 via a drive shaft 62. The drive shaft 62 may be arranged to rotate with the rotor 612, for example, by being pressed into the rotor 612 of the motor 61. The drive shaft 62 may, for example, partially pass through a rear wall of the tub 30 to connect the drum 40 with the motor 61. The drive unit 60 may be adapted to cause the drum 40 to rotate forward or rotate backward so that washing, rinsing, and/or dewatering operations are properly performed.

In an example, the washing machine 1 may include a water supply device 70 for supplying washing water to the drum 40 and/or the tub 30. The water supply device 70 may include at least one water supply pipe 71 and at least one water supply valve 72. The at least one water supply pipe 71 may be arranged to supply washing water to the interior of the tub 30, using an external water source. One of the at least one water supply pipe 71 may be connected to the detergent supply device 100 provided within the housing 10. Here, an inside of the detergent supply device 100 may be divided into a plurality of spaces, each of which may be arranged to receive a detergent, a rinse agent or the like therein. After passing through the detergent supply device 100, washing water may be supplied to the tub 30 along with the detergent (or rinsing agent) via a detergent supply pipe 101. Another one of the at least one water supply pipe 71 may be directly connected to the tub 30. For example, the washing water supplied through the water supply line 71 that is directly connected to the tub 30 may be fed directly to the tub 30 without going through an intermediate configuration such as the detergent supply device 100.

In an example, the washing machine 1 may include a drain unit 80 for draining the washing water received in the drum 40 and/or the tub 30. The drain unit 80 may include a drain valve 81, a first drain pipe 82, a second drain pipe 83, or a pump chamber 84. The drain unit 80 may be disposed, for example, beneath the tub 30 to discharge the washing water discharged from the tub 30 to the outside of the washing machine 1.

In an example, the drain valve 81 may be arranged to open and close the drain hole 32. When the drain valve 81 is open, the washing water received in the tub 30 may flow through the drain hole 32 into the drain unit 80.

In an example, the first drain pipe 82 and the second drain pipe 83 may form a flow path to guide the washing water to drain to the outside. For convenience of description, on the basis of the pump chamber 84, its upstream is referred to as the first drain pipe 82 and its downstream is referred to as the second drain pipe 83. The first drain pipe 82 and the second drain pipe 83 may be integrally formed. The first drain pipe 82 may be connected, for example, at one end, to the drain hole 32 and, at the other end, to the pump chamber 84. The washing water may travel along the first drain pipe 82 into the pump chamber 84. The second drain pipe 83 may be connected, for example, at one end, to the pump chamber 84 and, at the other end, to the exterior of the washing machine 1. Thus, the washing water passing through the pump chamber 84 may be discharged along the second drain pipe 83 to the exterior of the washing machine 1.

In an example, the pump chamber 84 may be provided below the tub 30 to store the washing water draining from the tub 30. Within the pump chamber 84, a drain pump 841 may be provided, for example, to drain the stored washing water to the outside. The washing water pumped by the drain pump 841 may be directed to the exterior of the housing 10 via the second drain pipe 83.

Figure 3:
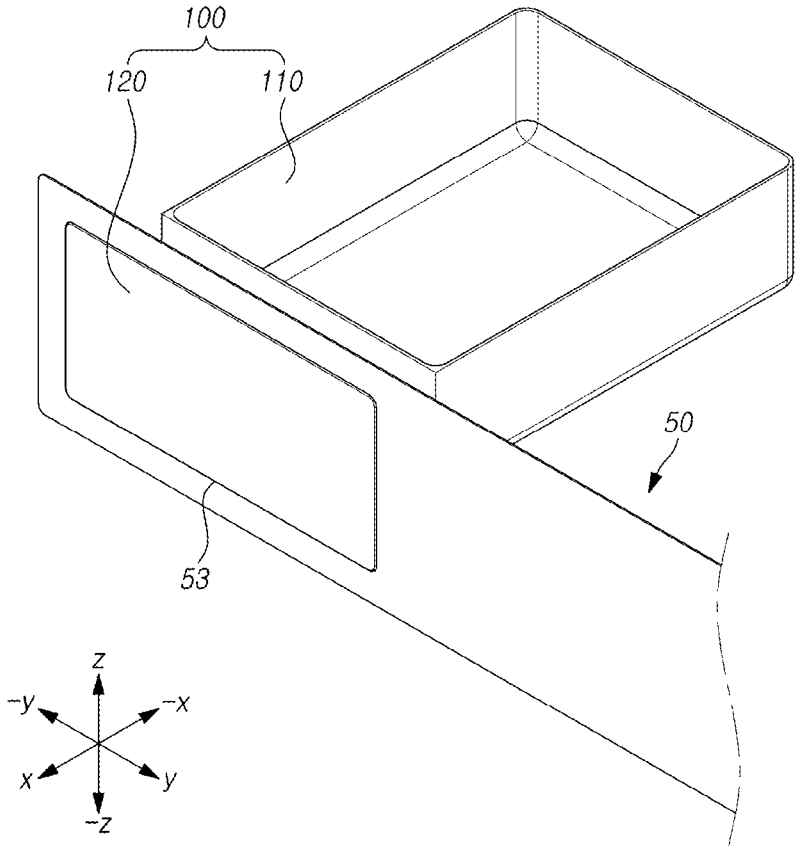
FIG. 3 is a schematic diagram illustrating an example of a detergent supply device inserted into a housing through an opening in a control panel according to an embodiment.
Figure 4:
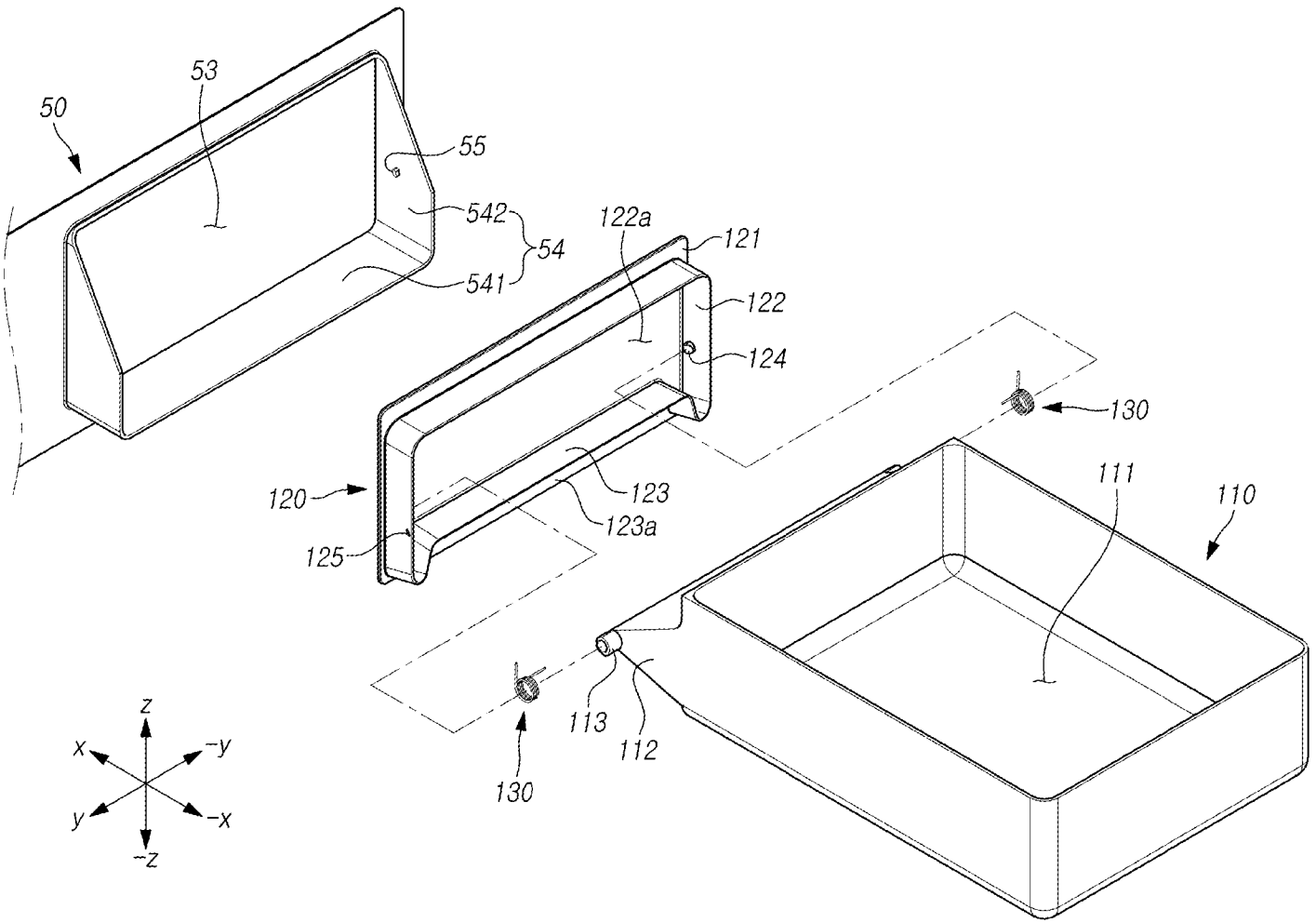
FIG. 4 is an exploded perspective view of a detergent supply device detached from an opening in a control panel according to an embodiment.
Figure 5:
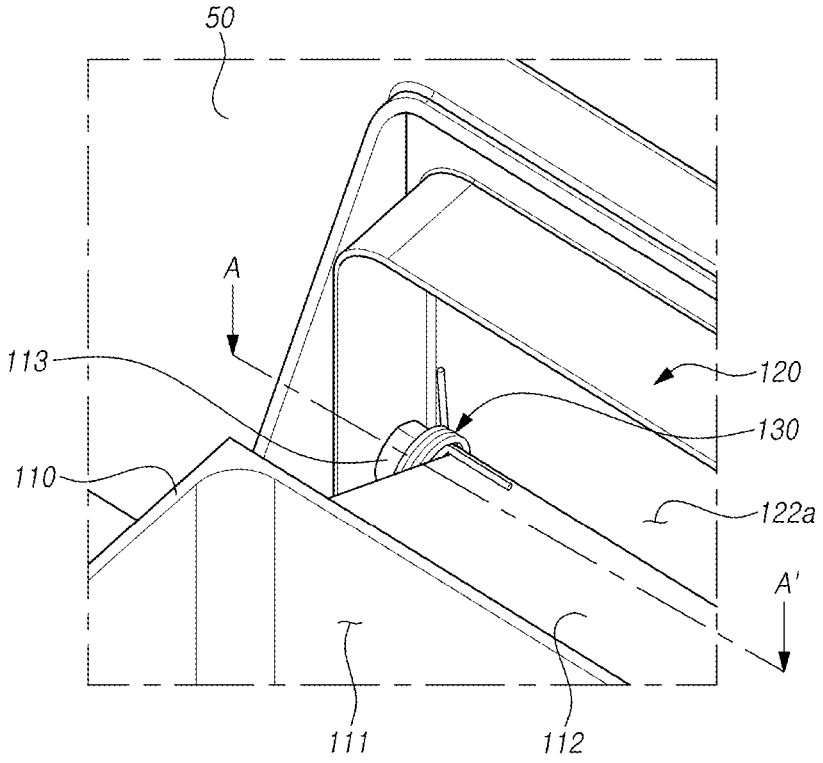
FIG. 5 is a partially enlarged view of coupling between a handle, a connection, and a body of a detergent supply device, according to an embodiment.
Figure 6:
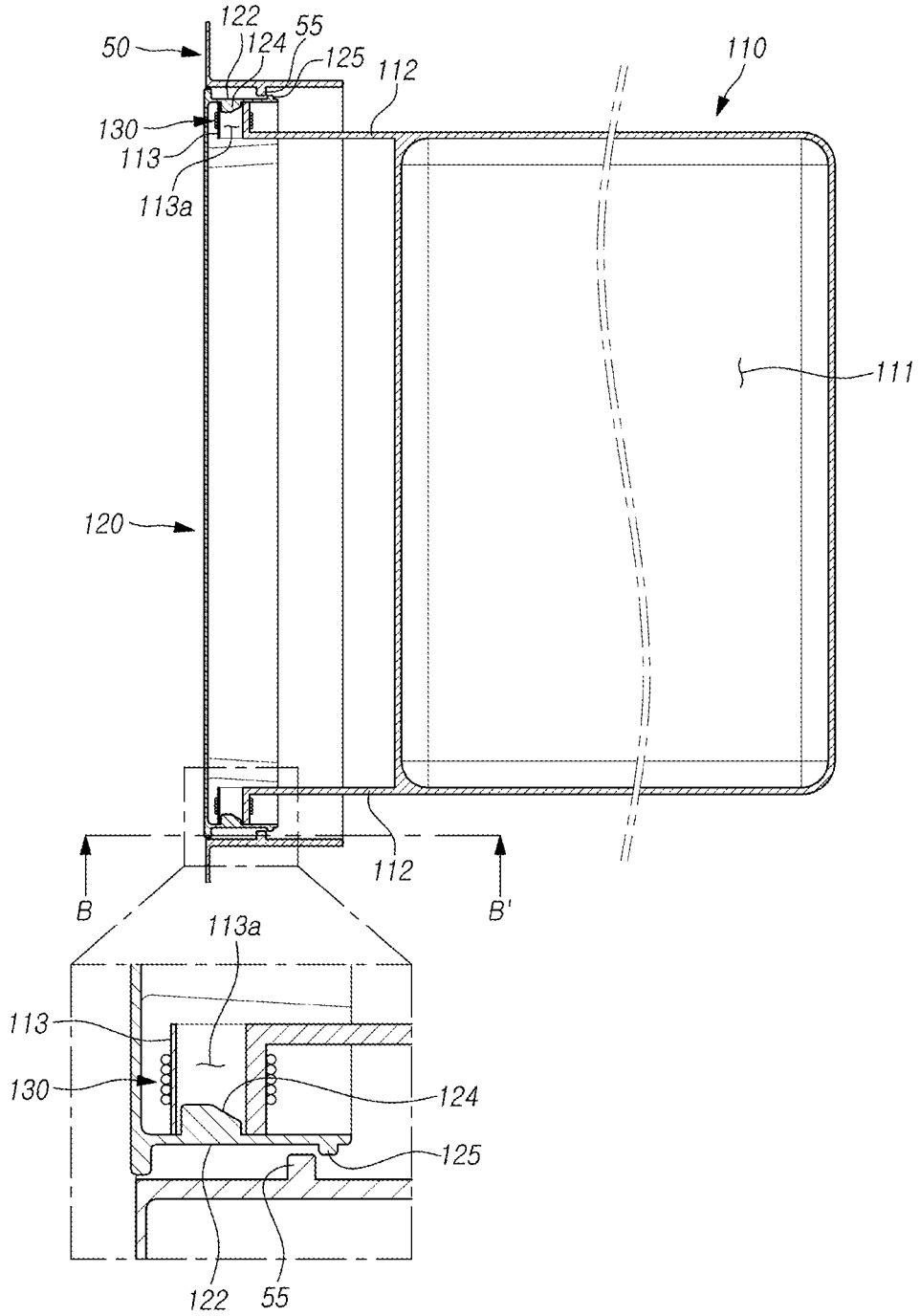
FIG. 6 is a cross-sectional view taken along a line A-A' shown in FIG. 5.

FIG. 3 is a schematic diagram illustrating an example of a detergent supply device inserted into a housing through an opening in a control panel according to an embodiment. FIG. 4 is an exploded perspective view of a detergent supply device detached from an opening in a control panel according to an embodiment. FIG. 5 is a partially enlarged view of coupling between a handle, a connection, and a body of a detergent supply device, according to an embodiment. And FIG. 6 is a cross-sectional view taken along a line A-A' shown in FIG. 5.

Referring to FIGS. 3, 4, 5 and 6, in an embodiment, the detergent supply device 100 may be arranged to be drawn into the interior of the washing machine 1 or drawn out of the exterior thereof through the opening 53 provided in the control panel 50.

According to an embodiment, a front surface of the control panel 50 may be provided with the opening 53 that is open to the front side (e.g., in +X axis direction). In an example, the opening 53 may have a substantially rectangular shape when viewed from the front side of the control panel 50, but the present disclosure is not limited thereto. In an embodiment, the opening 53 may be disposed to the left (e.g., in −Y-axis direction) of the front of the control panel 50, and the present disclosure is not limited thereto. In an embodiment, the opening 53 may cause an interior of the washing machine 1 to communicate with an exterior of the washing machine 1.

According to an embodiment, the control panel 50 may include a guide 54 extending rearwardly (e.g., in −X axis direction) from a periphery of the opening 53. In an embodiment, the detergent supply device guide 54 may include a bottom portion 541 extending rearwardly from a bottom end of the opening 53, and a pair of side portions 542 extending rearwardly from both side ends of the opening 53. In an embodiment, the top surface of the side portions 542 may be formed to have a slanting surface that slopes downward from an apex at the top of the opening 53. The guide 54 may guide or support movement of the detergent supply device 100, as the detergent supply device 100 is moved to be drawn into and out of the washing machine 1 through the opening 53 of the control panel 50.

According to an embodiment, fixing protrusions 55 may be provided on each inner surface of the pair of side portions 542 of the detergent supply device guide 54. In an embodiment, the pair of fixing protrusions 55 may be formed to protrude from the inner surface of each of the pair of side portions 542. As can be seen from FIGS. 4 and 6, the pair of fixing protrusions 55 may protrude laterally from each inner surface of the pair of side portions 542 of the detergent supply device guide 54 so that the pair of fixing protrusions 55 face each other. The structure, shape, and function of the pair of fixing protrusions 55 will be described in more detail below.

According to an embodiment, the detergent supply device 100 may include a body 110 configured to receive detergent and a handle 120 rotatably coupled to the body 110. In an embodiment, the handle 120 may be rotatably coupled to the body 110 in a hinged configuration.

According to an embodiment, the body 110 of the detergent supply device 100 may form a detergent receiving space 111 for receiving detergent therein. In an embodiment, the body 110 has an open top surface, and the detergent may be introduced into the detergent receiving space 111 through the open top surface. In an embodiment, the detergent receiving space 111 may be provided with a single detergent receiving space, but the present disclosure is not limited thereto. In some embodiments, the detergent receiving space 111 may be compartmentalized into a plurality of detergent receiving spaces, wherein the plurality of detergent receiving spaces may be configured to hold laundry detergent or rinsing agent (or, fabric softener) therein.

According to an embodiment, the body 110 may include a connection part 112 that supports rotation of the handle 120. In an embodiment, the connection part 112 may extend from the front surface of the body 110. In an embodiment, the connection part 112 may be integrally formed with the body 110. In an embodiment, the connection part 112 may have a top surface that slopes downwardly as it goes further away from the front surface of the body 110.

According to an embodiment, each of the both sides of the connection part 112 may be provided with a fitting groove 113 into which a fitting protrusion 124 of the handle 120 to be described later may be fitted. In an embodiment, the fitting grooves 113 may be formed to protrude in a horizontal direction (e.g., in Y-axis direction) from each of the both sides of the connection part 112. In an embodiment, the fitting grooves 113 may be disposed at the front side edges of the connection part 112. In an embodiment, the fitting grooves 113 may be integrally formed into the connection part 112, but the present disclosure is not limited thereto. In an embodiment, the fitting grooves 113 may be provided to have the shape of a substantially hollow column in its inside.

According to an embodiment, the handle 120 may include a cover 121, a rotating portion 122, a grip portion 123, a pair of fitting protrusions 124, and a pair of locking protrusions 125.

According to an embodiment, the cover 121 may have a shape corresponding to the opening 53 of the control panel 50. The cover 121 may have a generally flat (e.g., rectangular) shape, for example. In an example, the cover 121 may be configured to form a single continuous surface with the control panel 50, while the detergent supply device 100 is in a state of having been drawn into the interior of the housing 10 through the opening 53 of the control panel 50.

According to an embodiment, a back side (e.g., a side facing the −X axis) of the cover 121 may be provided with the rotating portion 122 extending along a back edge of the cover 121. In an embodiment, the rotating portion 122 may extend in a vertical direction (e.g., in −X axis direction) from the back surface of the cover 121. In an embodiment, the rotating portion 122 may form a space 122*a* in which at least a portion of the connection part 112 of the body 110 is received.

According to an embodiment, a grip portion 123 may be provided at a lower part of the rotating portion 122. In an embodiment, the grip portion 123 may refer to an upwardly bending portion formed as a lower part of the rotating portion 122. In an embodiment, the grip portion 123 may be disposed spaced apart by a predetermined distance from the bottom end of the cover 121. In an embodiment, the grip portion 123 may, together with the cover 121, define a gripping space 123*a* that is exposed to the outside of the washing machine 1 upon pivoting of the handle 120 to accommodate a finger of the user.

In such a circumstance, when the user is looking at the control panel 50 from the outside, the grip portion 123 is not exposed to the outside, so that the control panel 50 and the detergent supply device 100 may be extended in a single continuous surface to form a front appearance of the washing machine 1.

According to an embodiment, a pair of fitting protrusions 124 may be provided on each of both the inner faces of the rotating portion 122. In an embodiment, the fitting protrusions 124 may be formed to protrude from both the inner faces of the rotating portion 122. In an embodiment, as shown in FIGS. 5 and 6, the fitting protrusions 124 may be fitted into each of the corresponding fitting grooves 113 provided in the connection part 112. In an embodiment, as the fitting protrusions 124 are inserted into a hollow portion 113*a* of each corresponding fitting groove 113, the handle 120 may rotate about the fitting grooves 113 and/or the fitting protrusions 124 with respect to the body 110.

As described above, the fitting protrusions 124 may be provided on the handle 120 of the detergent supply device 100, and the fitting grooves 113 may be provided on the body 110. Alternatively, in some detergent supply devices, the fitting protrusions may be configured to be provided on the body of the detergent supply device and the fitting grooves may be provided on the handle thereof, as opposed to the formation as described above.

According to an embodiment, the detergent supply device 100 may include an elastic member 130 for providing resilience to the handle 120 so that the handle 120 returns to its original position when rotated by an external force. In an embodiment, the elastic member 130 may include a torsion spring (e.g., a torsion spring 131 of FIG. 8A). In an embodiment, the elastic member 130 may be disposed to envelop the fitting groove 113 of the body 110.

According to an embodiment, a pair of locking protrusions 125 may be provided on each of the two outer faces of the rotating portion 122. In an embodiment, the locking protrusions 125 may be formed to protrude from both the outer faces of the rotating portion 122. As will be described later, the locking protrusions 125 formed on the outer surfaces of the rotating portion 122 may interfere with the fixing protrusions 55 of the guide 54 described above, thereby preventing the detergent supply device 100 from being unintentionally drawn-out or opened through the opening 53 during operation of the washing machine 1.

Figure 7A:
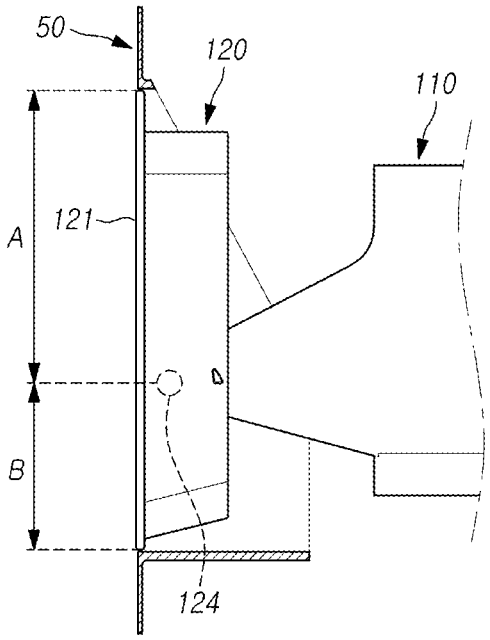
FIGS. 7A and 7B are side views illustrating respective states of a handle before it is rotated and after it is rotated, in response to applying an external force to a detergent supply device, according to an embodiment.
Figure 7B:
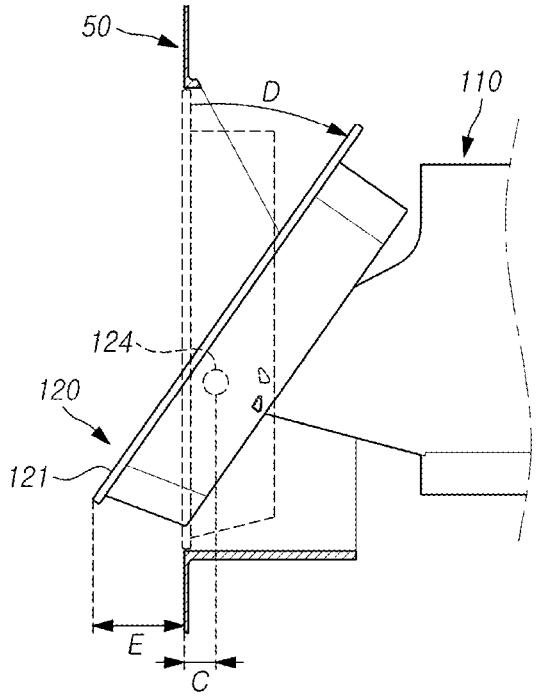

FIG. 7 are side views illustrating respective states of a handle before it is rotated and after it is rotated, according to applying an external force to a detergent supply device according to an embodiment. FIG. 7A is a diagram illustrating a state in which no external force is applied to the handle 120 of the detergent supply device 100 according to an embodiment, with the handle 120 being not rotated. FIG. 7B is a diagram illustrating a state in which an external force is applied to the handle 120 of the detergent supply device 100 according to an embodiment, with the handle 120 being rotated.

Referring to FIG. 7A, a cover 121 of the handle 120 may be disposed to form substantially the same plane as the control panel 50, and the rotating portion 122 may be disposed in the vertical direction. On both the inner sides of the rotating portion 122 may be disposed the fitting protrusions 124. A rotation axis may be defined by a pair of fitting protrusions 124 (and the fitting grooves 113 coupled thereto).

In an embodiment, a user may rotate the handle 120 by pushing a part of the cover 121, for example, any region corresponding to the upper portion with respect to the rotation axis defined by the pair of fitting protrusions 124. In an embodiment, the upper region of the cover 121, corresponding to the upper portion above the pair of fitting protrusions 124 and the axis of rotation defined thereby, may be referred to as a region where a pushing force from the user is applied to rotate the handle 120. In an example, the upper region may be tilted toward an inner side of the housing 120 when the handle 120 is rotated.

According to an embodiment, the height A of such an upper region of the cover 121, i.e., the upper region above the fitting protrusions 124, may be designed to account for the extent to which a user can depress the handle 120 with his/her thumb when the handle 120 is rotated. For example, the height A of the upper portion of the cover 121 may be configured to be approximately 70 millimeters.

According to an embodiment, the lower portion of the cover 121, i.e., the lower region below the fitting protrusion 124, may be a region where the user's pulling force is applied when the handle 120 is rotated. In an example, the lower region may be configured to be tilted toward an outer side of the housing 120 when the handle 120 is rotated. In an embodiment, the height B of the lower region of the cover 121 may correspond substantially to the height of the grip portion (e.g., the grip portion 123 in FIG. 4), although not specifically shown herein.

According to an embodiment, the height B of the lower region of the cover 121 may be designed to account for the extent to which a user may pull the grip portion 123 using his/her fingers other than the thumb when the handle 120 is rotated. In an embodiment, the height B of the lower region of the cover 121 may be designed to be lower than the height A of the upper region of the cover 121. The height B of the lower region of the cover 121 may be configured to be, for example, approximately 20 mm.

Referring to FIG. 7B, in an embodiment, a separation distance C between the cover 121 and the fitting protrusion 124 may be configured to account for interference of the cover 121 with the inner surface of the control panel 50. In an example, when the handle 120 is rotated by applying external force by a user to the cover 121, a periphery of the cover 121 may interfere with a periphery of the inner surface of the control panel 50. In particular, the position of the fitting protrusion 124 disposed on the rotation axis for rotation of the handle 120, i.e., the rotating portion 122, is further away from the cover 121, the possibility of interference between the cover 121 and the control panel 50 may become greater. For example, in case where the separation distance C between the cover 121 and the fitting protrusion 124 is relatively greater, the top end of the cover 121 may come into contact with the inner surface of the control panel 50 during rotation of the handle 120 so as to interfere with rotation of the handle 120 or movement of the detergent supply device 100. As such, the fitting protrusions 124 may be disposed close to the cover 121 to reduce such interference. In an example, the separation distance C between the cover 121 and the fitting protrusions 124 may be configured to have a minimal value, such that the separation distance C between the cover 121 and the fitting protrusions 124 may be designed to be, for example, approximately 8 mm.

According to an embodiment, a rotation angle D of the handle 120 may be configured to take into account the size of the gripping space 123*a* of the grip portion 123 that is exposed to the outside when the handle 120 is rotated. The rotation angle D of the handle 120 may be designed to be, for example, approximately 35 degrees.

According to an embodiment, a vertical distance E from a bottom end of the cover 121 to the opening 53 when the handle 120 is rotated may be configured such that a user's finger can fit therethrough. The vertical distance E may be designed to be, for example, approximately 20 millimeters.

FIG. 8 is a diagram illustrating an elastic member arranged in a detergent supply device according to various embodiments.

Figure 8A:
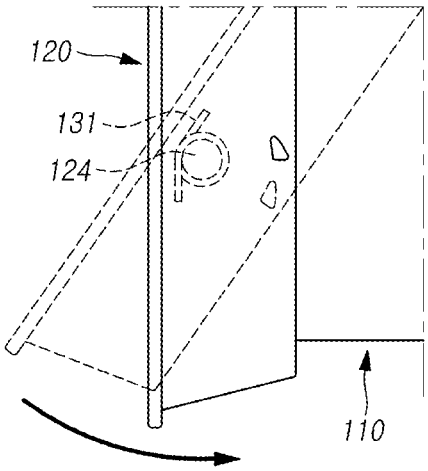
FIGS. 8A, 8B, and 8C are schematic diagrams illustrating an elastic member provided in a detergent supply device according to various embodiments.
Figure 8B:
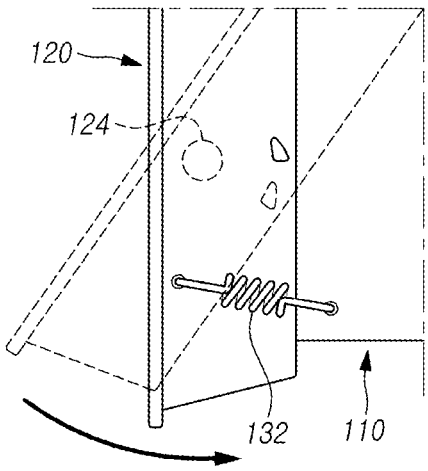
Figure 8C:
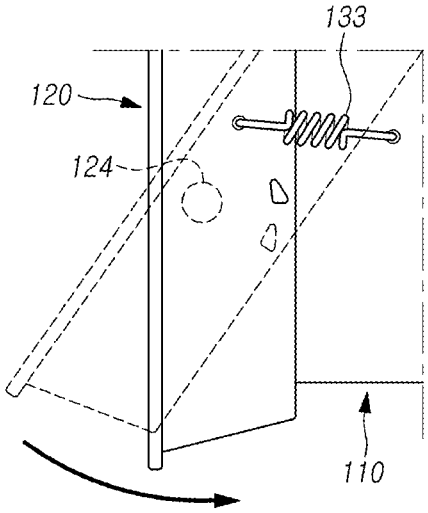

FIG. 8A is a diagram illustrating a rotated detergent handle 120 being returned to its original position by a torsion spring 131. FIG. 8B is a diagram illustrating a rotated detergent handle 120 being returned to its original position by a tension spring 132. And FIG. 8C is a diagram illustrating a rotated detergent handle 120 being returned to its original position by a compression spring 133.

As shown in FIG. 8A, in an embodiment, the elastic member 130 may include a torsion spring 131.

According to an embodiment, the torsion spring 131 may be disposed to wrap around the fitting groove 113 of the body 110. In an embodiment, the torsion spring 131 may be arranged to apply a rotational force in a direction opposite to the direction of rotation of the handle 120 (e.g., counter-clockwise) upon rotation of the handle 120. In this case, when an external force applied to the handle 120 is removed, the handle 120 rotated by the external force returns to its original position by the rotational force (or, restoring force) of the torsion spring 131.

As shown in FIG. 8B, in an embodiment, the elastic member 130 may include a tension spring 132.

According to an embodiment, the tension spring 132 may connect the handle 120 with the body 110. In an embodiment, the tension spring 132 may be located below the fitting protrusion 124 of the handle 120. In an embodiment, the tension spring 132 may be connected to each of the bottom part of the rotating portion 122 of the handle 120 and the bottom part of the connection part 112 of the body 110. In this case, the handle 120 rotates to tension the tension spring 132, and an elastic force is exerted onto the handle 120 in the direction opposite to the tensioning of the tension spring 132. Then, when the external force applied to the handle 120 is removed, the elastic force (or, restoring force) of the tension spring 132 causes the handle 120 to return to its original position.

In an embodiment, the elastic member 130 may include a compression spring 133, as shown in FIG. 8C.

According to an embodiment, the compression spring 133 may connect the handle 120 and the body 110. In an embodiment, the compression spring 133 may be located above the fitting protrusion 124 of the handle 120. In an embodiment, the compression spring 133 may be connected to each of the top of the rotating portion 122 of the handle 120 and the top of the connection part 112 of the body 110. In this case, rotation of the handle 120 compresses the compression spring 133, and an elastic force is exerted onto the handle 120 in a direction opposite to the compression of the compression spring 133. Thereafter, when the external force applied to the handle 120 is removed, the elastic force (or, restoring force) of the compression spring 133 causes the handle 120 to return to its original position.

FIG. 9 is a diagram to illustrate a drawing-out process of a detergent supply device according to an embodiment.

Figure 9A:
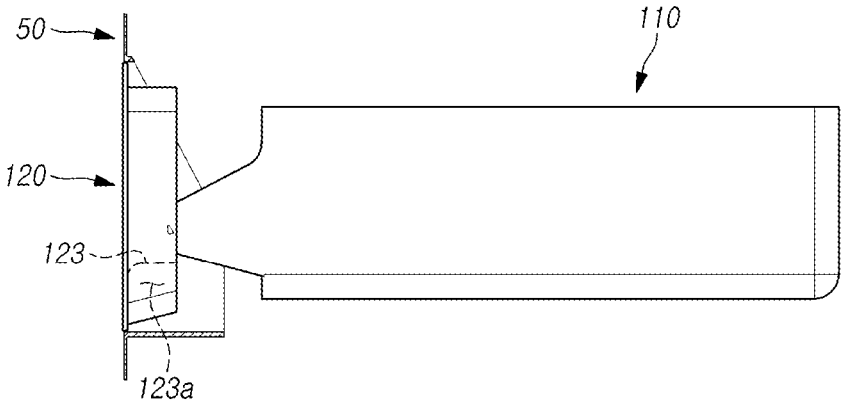
FIGS. 9A and 9B are schematic diagrams to illustrate a drawing-out process of a detergent supply device according to an embodiment.

FIG. 9A is a schematic side view of a detergent supply device 100 with no external force applied.

Figure 9B:
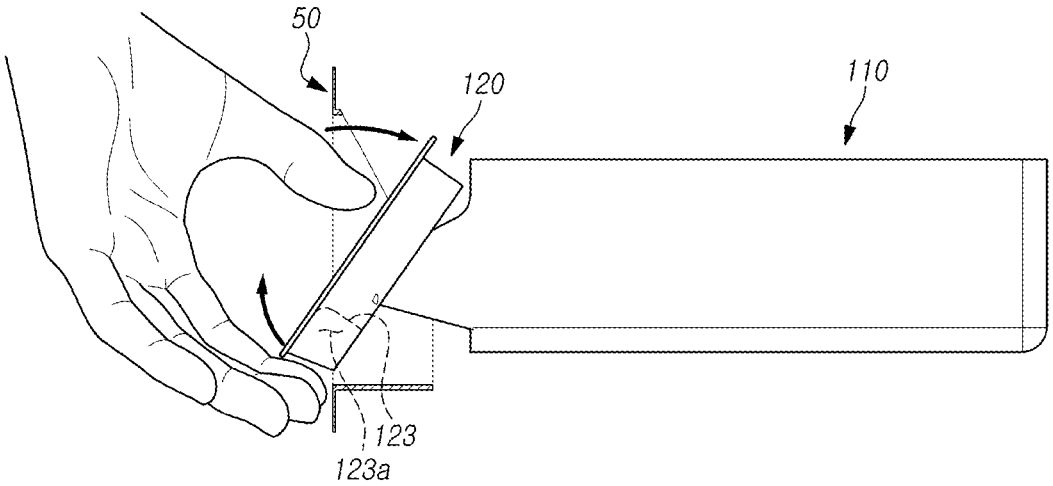

FIG. 9B is a schematic side view of a detergent supply device 100 showing rotation of the handle 120 of the detergent supply device 100 with an external force applied thereto.

Referring to FIG. 9, the user may depress an upper portion of the cover 121 of the handle 120 of the detergent supply device 100 using his/her thumb to rotate the handle 120 in a clockwise direction. When the handle 120 is rotated clockwise by the user's depressing action, the grip portion 123 of the handle 120, which is concealed in the inner side of the control panel 50, may be exposed to the outside, and the user may insert fingers other than the thumb into the gripping space 123*a* of the exposed grip portion 123 to grip the handle 120, and then pull the handle 120 outwardly (e.g., forward) to draw out the detergent supply device 100 out of the washing machine 1.

Figure 10:
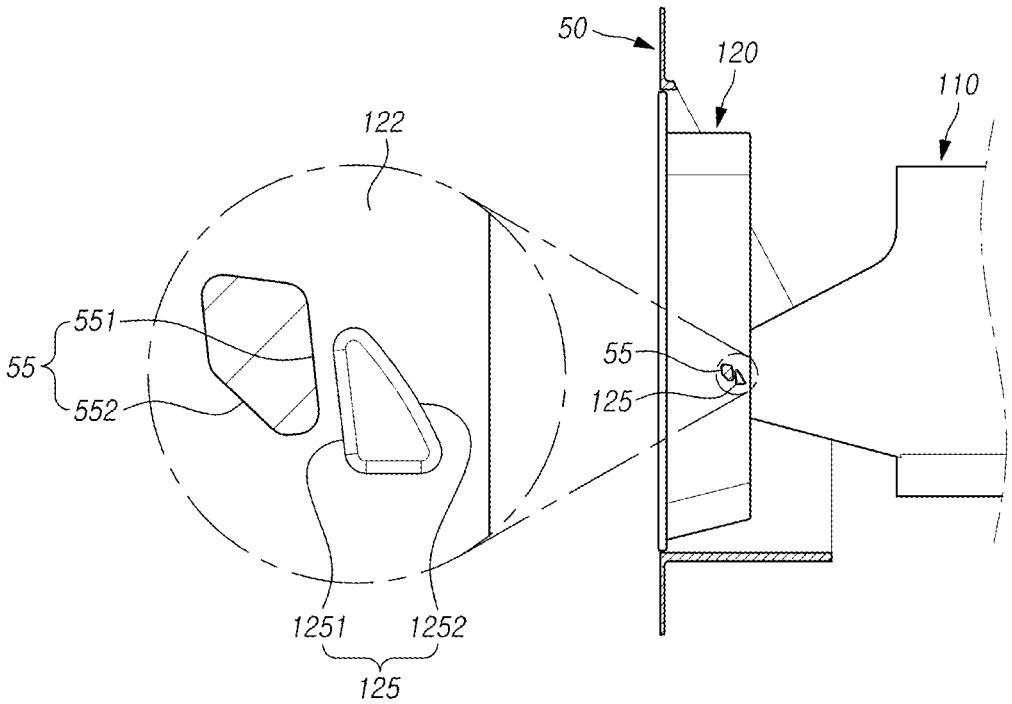
FIG. 10 is a cross-sectional view of a detergent supply device taken along a line B-B' shown in FIG. 6.

FIG. 10 is a cross-sectional view of a detergent supply device 100 taken along a lines B-B' shown in FIG. 6.

Referring to FIG. 10, in an embodiment, locking protrusions 125 may be provided on both the outer faces of the rotating portion 122 of the handle 120.

According to an embodiment, the locking protrusions 125 may be disposed in a direction opposite the fixing protrusions 55 formed on each inner surface of the detergent supply device guide 54 of the control panel 50. In an embodiment, the locking protrusions 125 may be disposed adjacent to the corresponding fixing protrusions 55 behind each corresponding fixing protrusion 55 (e.g., a position inside the housing 10). In an embodiment, the locking protrusion 125 may have a front surface 1251 that faces the fixing protrusion 55. In an embodiment, the front surface 1251 of the locking protrusion 125 may be a vertical surface or may be formed to slant forward with a predetermined angle (e.g., an acute angle). In an embodiment, the locking protrusion 125 may have a sloped surface 1252 connected to the top end of the front surface 1251 of the locking protrusion 125 and having a slope downwardly from the top end of the front surface 1251 to the rear.

According to an embodiment, the fixing protrusion 55 may have a rear surface 551 that faces the front surface 1251 of the locking protrusion 125. In an embodiment, the rear surface 551 of the fixing protrusion 55 may be arranged to be parallel to the front surface 1251 of the locking protrusion 125. The rear surface 551 of the fixing protrusion 55 may be, for example, a vertical surface, or may be sloped forwardly to form a predetermined angle (e.g., an acute angle). In an embodiment, the fixing protrusion 55 may have an inclined surface 552 that is connected to the lower end of the rear surface 551 of the fixing protrusion 55 and has a slope extending upwardly from the lower end of the rear surface 551 to the front side.

FIG. 11 are schematic diagrams to illustrate an interference relationship between a fixing protrusion of a control panel and a locking protrusion of a detergent supply device, according to an embodiment.

Figure 11A:
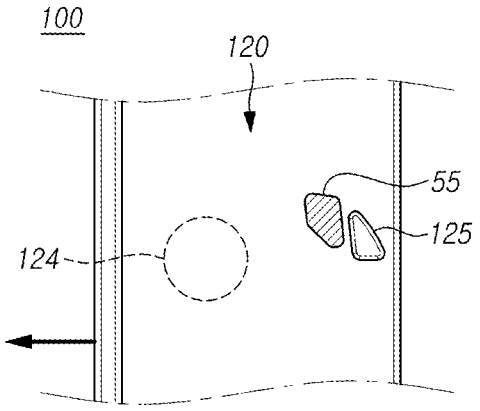
FIGS. 11A and 11B are schematic diagrams to illustrate the interference relationship between a fixing protrusion of a control panel and a locking protrusion of a detergent supply device, according to an embodiment.
Figure 11B:
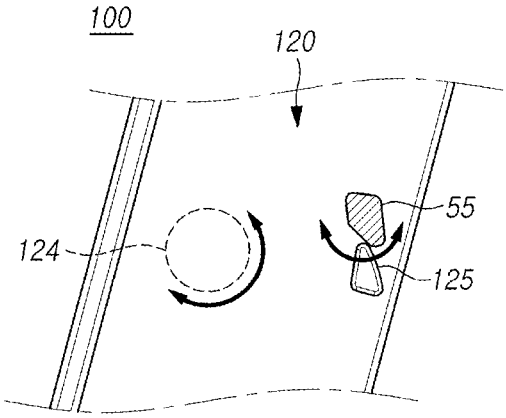

FIG. 11A is a diagram illustrating a locked state of the detergent supply device and FIG. 11B is a diagram illustrating an open state of the detergent supply device.

When the washing machine 1 operates with no external force applied to the detergent supply device 100 by the user, the detergent supply device 100 may be moved back and forth directions due to vibrations or the like that may be generated during the operation of the washing machine 1. When the detergent supply device 100 is moved forward by the vibrations or the like, the locking protrusion 125 arranged on the handle 120 may come into contact with the fixing protrusion 55 of the control panel 50 and restrict the forward movement of the detergent supply device 100, and thus, the detergent supply device 100 may be prevented from being drawn out to the outside, excepting for the case that the user separately applies any external force to the detergent supply device 100.

As described above, when any separate external force is not applied by the user to the handle 120 of the detergent supply device 100, a state that the draw-out of the detergent supply device 100 to the outside is restricted due to the interference between the locking protrusion 125 and the fixing protrusion 55 may be referred to as a locked state of the detergent supply device 100. As can be seen from FIGS. 4, 11A and 11B, when in the locked state, the locking protrusion 125 is disposed at a position closer to the body 110 than the fixing protrusion 55 is to the body 110.

As shown in FIG. 11B, when an external force is applied by a user to the detergent supply device 100 to draw out the detergent supply device 100, the handle 120 is caused to rotate clockwise about the axis of rotation defined by the fitting protrusion 124, and at the same time, the locking protrusion 125 arranged on the rotating portion 122 is also rotated along the sloped surface of the fixing protrusion 55 arranged on the control panel 50. As such, a state in which the handle (120) is rotated by releasing the locked state of the detergent supply device 100 may be referred to as an open state.

In an example, when the external force applied to the handle 120 by the user is removed during the rotation of the handle 120, the resilience of the elastic members (e.g., 131, 132 or 133 of FIG. 8) provided on the detergent supply device 100 (although not specifically shown) causes the handle 120 to rotate counterclockwise, and at the same time, the locking protrusion 125 provided on the rotating portion 122 is also rotated along the sloped surface of the fixing protrusion 55 provided on the control panel 50.

As a result, the detergent supply device 100 may change its state between the locked state and the open state as described above, due to the interference of the locking protrusion 125 and the fixing protrusion 55.

Figure 12:
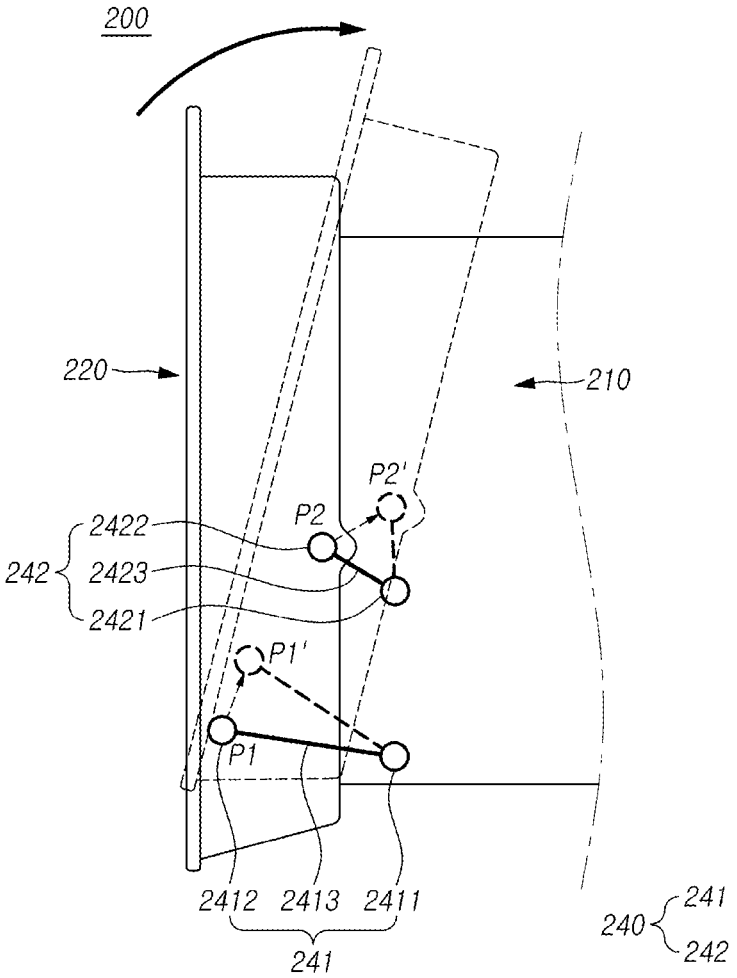
FIG. 12 is a schematic diagram illustrating a pivoting structure of a handle of a detergent supply device according to an embodiment.

FIG. 12 is a schematic diagram illustrating a pivoting structure of a handle of a detergent supply device according to an embodiment. Specifically, FIG. 12 is a schematic diagram illustrating the detergent supply device having a link-type pivoting structure.

In describing the present embodiment, for the configurations of the detergent supply device 200 that are substantially the same or similar in structure, shape, and function to those of the detergent supply device 100 described above in FIGS. 3 to 11, the description may be made substantially in the same manner as that of the configurations of the detergent supply device 100, and specific description thereof will be omitted hereinafter for brevity of description.

Referring to FIG. 12, in an embodiment, the detergent supply device 200 may include a body 210 and a handle 220 rotatably coupled to the body 210. In an embodiment, the handle 220 may be rotatably coupled to the body 210 in a link structure.

According to an embodiment, the detergent supply device 200 may include a link structure 240. In an embodiment, the link structure 240 may include a first link structure 241 connecting the handle 220 to the body 210, and a second link structure 242 connecting the handle 220 to the body 210 above the first link structure 241.

According to an embodiment, the first link structure 241 may include a $(1\text{-}1)^{th}$ link axis 2411 fixedly disposed on a side of the body 210, a $(1\text{-}2)^{th}$ link axis 2412 fixedly disposed on one side of the rotating portion 222 of the handle 220, and a first link bar 2413 connecting the $(1\text{-}1)^{th}$ link axis 2411 and the $(1\text{-}2)^{th}$ link axis 2412. In this case, the handle 220 may be arranged to rotate by a predetermined section about the $(1\text{-}1)^{th}$ link axis 2411 of the first link structure 241 with respect to the body 210.

According to an embodiment, the second link structure 242 may include a $(2\text{-}1)^{th}$ link axis 2421 fixedly disposed on one side of the body 210, a $(2\text{-}2)^{th}$ link axis 2422 fixedly disposed on one side of the rotating portion 222 of the handle 220, and a second link bar 2423 connecting the $(2\text{-}1)^{th}$ link axis 2421 and the $(2\text{-}2)^{th}$ link axis 2422. In this case, the handle 220 may be arranged to rotate by a predetermined section about the $(2\text{-}1)^{th}$ link axis 2421 of the second link structure 242 with respect to the body 210.

When a user applies an external force to the handle 120, the rotation of the handle 120 may be supported by the link structure 240. When the user applies an external force to the handle 220, the first link bar 2413 of the first link structure 241 may rotate with respect to the body 210 about the $(1\text{-}1)^{th}$ link axis 2411, causing the $(1\text{-}2)^{th}$ link axis 2412 to move from the $(1\text{-}1)^{th}$ position P1 to the $(1\text{-}2)^{th}$ position P1'. At the same time, the second link bar 2423 of the second link structure 242 is caused to rotate about the $(2\text{-}1)^{th}$ link axis 2421 with respect to the body 210, and the $(2\text{-}2)^{th}$ link axis 2422 is caused to move from the $(2\text{-}1)^{th}$ position P2 to the $(2\text{-}2)^{th}$ position P2'. Accordingly, the handle 220 is rotated clockwise by a predetermined angle with respect to the body 210 by the link structure 240.

Figure 13:
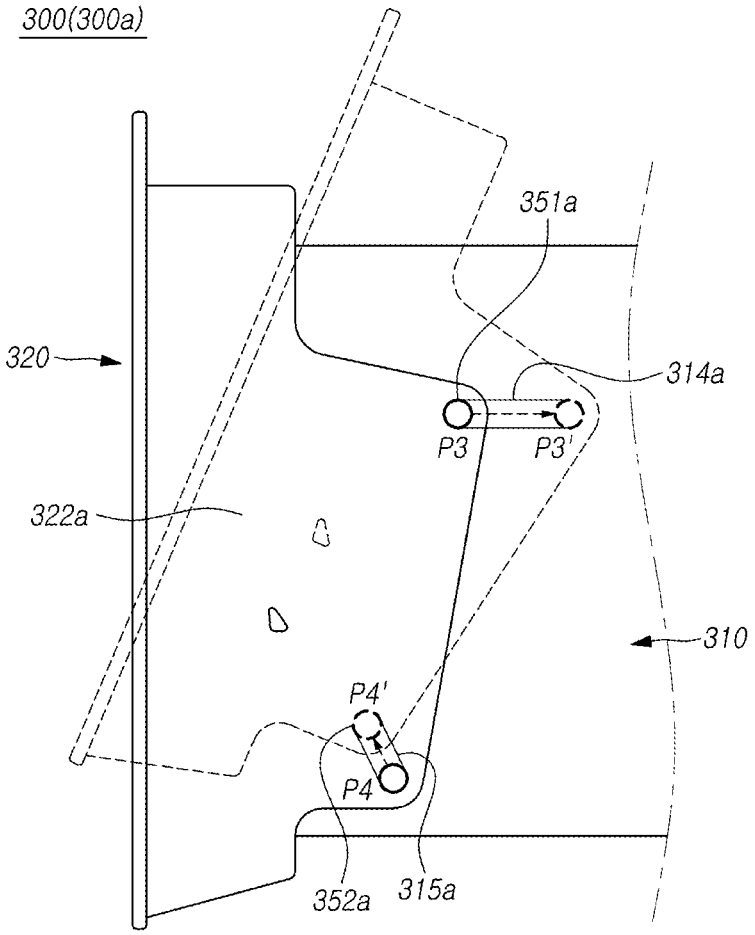
FIG. 13 is a schematic diagram illustrating a pivoting structure of a handle of a detergent supply device according to an embodiment.
Figure 14:
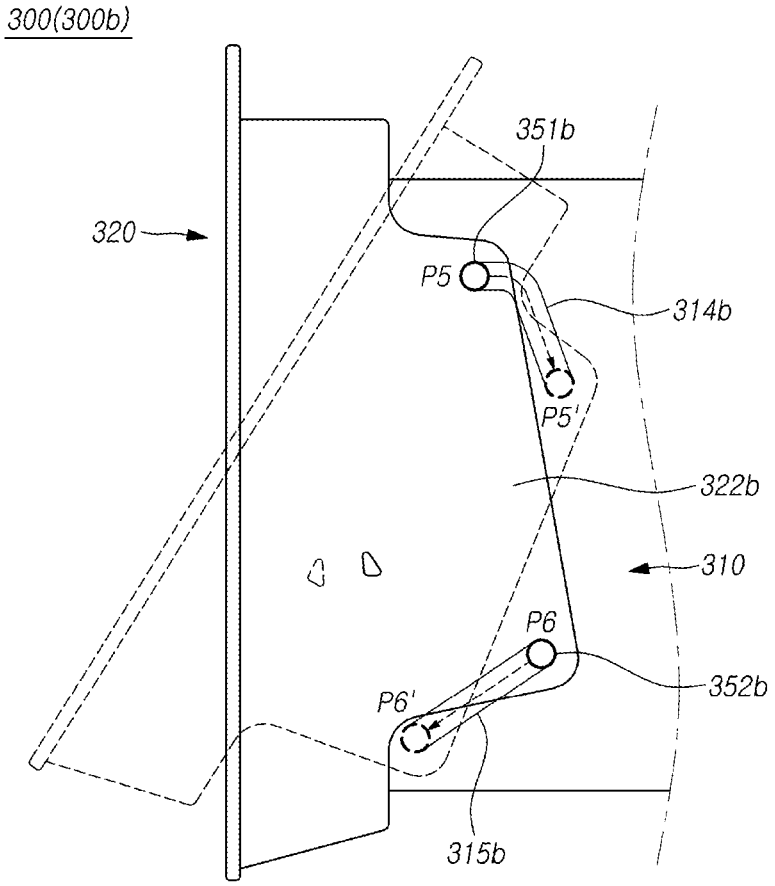
FIG. 14 is a schematic diagram illustrating a pivoting structure of a handle of a detergent supply device according to an embodiment.

FIG. 13 is a schematic diagram illustrating a pivoting structure of a handle of a detergent supply device according to an embodiment. FIG. 14 is a schematic diagram illustrating a pivoting structure of a handle of a detergent supply device according to an embodiment.

In describing the present embodiment, for the configurations of a detergent supply device 300 having substantially the same or similar structure, shape, and function as those of the detergent supply device 100 described above in FIGS. 3 through 11, the description may be made substantially in the same manner as that of the configuration of the detergent supply device 100, and specific description thereof will be omitted hereinafter for brevity of description.

As shown in FIGS. 13 and 14, in an embodiment, a detergent supply device 300*a* or 300*b* may include a body 310 and a handle 320 rotatably coupled to the body 310. In an embodiment, the handle 320 may be rotatably coupled to the body 310 in a slidable structure manner.

Referring to FIG. 13, in an embodiment, a first slide hole 314*a* and a second slide hole 315*a* may be provided on each of both sides of the body 310 of the detergent supply device 300*a*.

According to an embodiment, the first slide hole 314*a* may be formed as an opening on a side of the body 310 and extend in a horizontal direction. In an embodiment, the first slide hole 314*a* may provide a path for a first slide pin 351*a*, described later, to travel upon rotation of the handle 320.

According to an embodiment, the second slide hole 315*a* may be formed as an opening on a side of the body 310 and extend diagonally. In an embodiment, the second slide hole 315*a* may extend to be inclined upwardly from the lower side of the body 310 toward a front upper side.

According to an embodiment, a first slide pin 351*a* and a second slide pin 352*a* may be provided on each of the inner surfaces of a rotating portion 322*a* of the handle 320.

According to an embodiment, the first slide pin 351*a* may be formed to protrude from the inner surface of the rotating portion 322*a* of the handle 320 toward the first slide hole 314*a*. In an embodiment, the first slide pin 351*a* may be integrally formed in the rotating portion 322*a* of the handle 320, but the present disclosure is not limited thereto. In an embodiment, the first slide pin 351*a* may be at least partially inserted through the first slide hole 314*a* and may move along the first slide hole 314*a* upon rotation of the handle 320.

According to an embodiment, the second slide pin 352*a* may be formed to protrude from the inner surface of the rotating portion 322*a* of the handle 320 toward the second slide hole 315*a*. In an embodiment, the second slide pin 352*a* may be integrally formed in the rotating portion 322*a* of the handle 320, but the present disclosure is not limited thereto. In an embodiment, the second slide pin 352*a* may be located at a lower position than the first slide pin 351*a* on one side of the rotating portion 322*a*. In an embodiment, the second slide pin 352*a* may be positioned more forward than the first slide pin 351*a* on the side of the rotating portion 322*a*. In an embodiment, the second slide pin 352*a* may be inserted, at least partially, through the second slide hole 315*a* and may move along the second slide hole 315*a* upon rotation of the handle 320.

In such a circumstance, when a user applies an external force to the handle 320, movement of the slide pins 351*a* and 352*a* corresponding to the slide holes 314*a* and 315*a* may be guided by the slide holes 314*a* and 315*a*. Specifically, when the user depresses a top portion of the handle 320, the first slide pin 314*a* moves from a $(3\text{-}1)^{th}$ position P3 to another $(3\text{-}2)^{th}$ position P3' along a path formed by the first slide hole 351*a*. At the same time, the second slide pin 315*a* is also caused to move from a $(4\text{-}1)^{th}$ position (P4) to another $(4\text{-}2)^{th}$ position P4' along a path formed by the second slide hole 352*a*, thereby causing the handle 320 to rotate clockwise by a predetermined angle.

Referring to FIG. 14, in an embodiment, a first slide hole 314*b* and a second slide hole 315*b* may be provided on each of both sides of the body 310 of the detergent supply device 300*b*. The slide holes 314*b* and 315*b* shown in FIG. 14 may be arranged to provide different travelling paths compared to the slide holes 314*a*, 314*b* shown in FIG. 13.

According to an embodiment, the first slide hole 314*b* may be formed as an opening on one side of the body 310. In an embodiment, the first slide hole 314*b* may be divided into a first part formed in a horizontal direction, and a second part connected to the first part and extending in a different direction than the first part. Here, the second part may be formed to extend in an oblique direction downwardly to the rear.

According to an embodiment, the second slide hole 315*b* may be formed as an opening on one side of the body 310, extending in an oblique direction. In an embodiment, the second slide hole 315*b* may extend to be inclined from the lower side of the body 310 to the rear upper side.

According to an embodiment, a first slide pin 351*b* and a second slide pin 352*b* may be provided on each of the inner surfaces of the rotating portion 322*b* of the handle 320.

According to an embodiment, the first slide pin 351*b* may be formed to protrude from the inner surface of the rotatable portion 322*b* of the handle 320 toward the first slide hole 314*b*. In an embodiment, the first slide pin 351*b* may be integrally formed in the rotating portion 322*b* of the handle 320, but the present disclosure is not limited thereto. In an embodiment, the first slide pin 351*b* is at least partially inserted through the first slide hole 314*b* and may move along the first slide hole 314*b* upon rotation of the handle 320.

According to an embodiment, the second slide pin 352*b* may be formed to protrude from the inner surface of the rotating portion 322*b* of the handle 320 toward the second slide hole 315*b*. In an embodiment, the second slide pin 352*b* may be integrally formed in the rotating portion 322*b* of the handle 320, but the present disclosure is not limited thereto. In an embodiment, the second slide pin 352*b* may be located more below than the first slide pin 351*b* on one side of the rotatable portion 322*b*. In an embodiment, the second slide pin 352*b* may be located further rearward on the side surface of the rotation part 322*b* than the first slide pin 351*b*. In an embodiment, the second slide pin 352*b* may be inserted, at least in part, through the second slide hole 315*b* and may move along the second slide hole 315*b* upon rotation of the handle 320.

In such a case, when the user applies an external force to the handle 320, movement of the slide pins 351*b* and 352*b* corresponding to the slide holes 314*b* and 315*b* may be guided by the slide holes 314*b* and 315*b*. Specifically, when the user depresses a uppermost portion of the handle 320, the first slide pin 314*b* is caused to move from a $(5\text{-}1)^{th}$ position P5 to another $(5\text{-}2)^{th}$ position P5' along the path formed by the first slide hole 351*b*. At the same time, the second slide pin 315*b* is also caused to move from a $(6\text{-}1)^{th}$ position P6 to another $(6\text{-}2)^{th}$ position P6' along the path formed by the second slide hole 352*b*, thereby causing the handle 320 to rotate clockwise by a predetermined angle.

Figure 15:
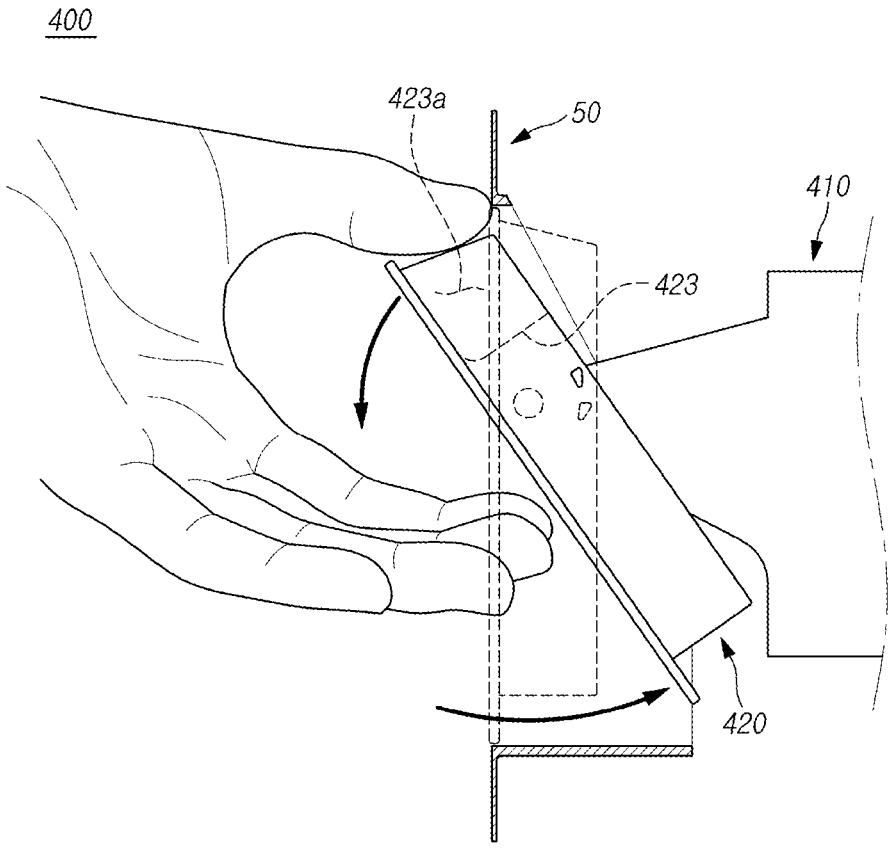
FIG. 15 is a schematic diagram to illustrate a pivoting operation of a handle of a detergent supply device according to an embodiment.

FIG. 15 is a schematic diagram to illustrate a pivoting operation of a handle of a detergent supply device according to an embodiment.

Referring to FIG. 15, in an embodiment, a detergent supply device 400 may include a body 410 and a handle 420 rotatably coupled to the body 410. The body 410 and the handle 420 may be arranged to have a substantially similar structure to the hinge structure of the detergent supply device 100, as shown in FIGS. 3 through 11, in which the grip portion 123 is caused to rotate clockwise to be exposed from the bottom of the washing machine 1 to the outside. However, as opposed to the detergent supply device 100 shown in FIGS. 3 through 11 above, the hinge structure of the handle 420 may be reversed such that when an external force is applied to the handle 420, the handle 420 rotates counter-clockwise so that the grip portion 423 is exposed to the exterior of the washing machine 1 from the top side.

Similar to the above in substance, the link structure of the handle 220 shown in FIG. 12 and the slide structure of the handle 320 shown in FIGS. 13 and 14 may also be arranged to have an inverted (upside-down) structure.

The terms as used herein are provided merely to describe some embodiments thereof, but are not intended to limit the disclosure. As used herein, the singular forms "a", "an", and "the" are intended to include the plural forms as well, unless the context clearly indicates otherwise. As used herein, each of such phrases as "A or B", "at least one of A and B", "at least one of A or B", "A, B, or C", "at least one of A, B, and C", and "at least one of A, B, or C" may include all possible combinations of the items enumerated together in a corresponding one of the phrases. As used herein, the term 'and/or' should be understood as encompassing any and all possible combinations by one or more of the enumerated items. As used herein, the terms "include", "have", and "comprise" are used merely to designate the presence of the feature, component, part, or a combination thereof described herein, but use of the term does not exclude the likelihood of presence or adding one or more other features, components, parts, or combinations thereof. As used herein, the terms "first" and "second" may modify various components regardless of importance and/or order and are used to distinguish a component from another without limiting the components.

As used herein, the terms "configured to" may be interchangeably used with the terms "suitable for", "having the capacity to", "designed to", "adapted to", "made to", or "capable of" depending on circumstances. The term "configured to" does not essentially mean "specifically designed in hardware to". Rather, the term "configured to" may mean that a device can perform an operation together with another device or parts. For example, a 'device configured (or set) to perform A, B, and C' may be a dedicated device to perform the corresponding operation or may mean a general-purpose device capable of various operations including the corresponding operation.

Meanwhile, the terms "upper side", "lower side", and "front and rear directions" used in the disclosure are defined with respect to the drawings, and the shape and position of each component are not limited by these terms.

In the disclosure, the above-described description has been made mainly of specific embodiments, but the disclosure is not limited to such specific embodiments, but should rather be appreciated as covering all various modifications, equivalents, and/or substitutes of various embodiments.

What is claimed is:

1. A washing machine, comprising:

a housing;

a control panel on a front surface of the housing and including an opening and a fixing protrusion; and a detergent supply device configured to be drawn into and out of the washing machine through the opening, the detergent supply device including:

a body to accommodate a detergent therein, and a handle rotatably connected to the body and including a locking protrusion, wherein the detergent supply device and the handle are configured so that the detergent supply device has a locked state in which the detergent supply device is drawn into the washing machine, the locking protrusion is disposed at a position closer to the body than the fixing protrusion is to the body, and forward movement of the detergent supply device through the opening due to vibrations generated during operation of the washing machine is restricted by the locking protrusion coming into contact with the fixing protrusion, and when the detergent supply device is in the locked state, the handle is rotatable to move the locking protrusion and thereby release the detergent supply device from the locked state so that the detergent supply device is in an open state in which forward movement of the detergent supply device through the opening is not restricted by contact between the locking protrusion and the fixing protrusion.

2. The washing machine of claim 1, wherein the handle includes a front surface, a back surface opposite the front surface and a grip portion on one side of the back surface, and wherein rotation of the handle moves the grip portion between being concealed within the control panel in the locked state and being exposed to an outside of the control panel in the open state.

3. The washing machine of claim 2, wherein the grip portion is recessed from the one side to an opposing side.

4. The washing machine of claim 2, wherein the front surface of the handle is aligned with the front surface of the control panel when the detergent supply device is in the locked state.

5. The washing machine of claim 1, wherein while no external force is applied to the handle, the detergent supply device is maintained in the locked state.

6. The washing machine of claim 1, wherein the handle is rotatable such that, in response to applying an external force to the handle, the locking protrusion is moved and changes the detergent supply device from the locked state to the open state, or from the open state to the locked state.

7. The washing machine of claim 1, further comprising:

a detergent supply device guide extending into the opening from a periphery of the opening; and a pair of fixing protrusions protruding laterally from an inner surface of the detergent supply device guide so that the fixing protrusions of the pair of fixing protrusions face each other.

8. The washing machine of claim 1, wherein the fixing protrusion includes a first vertical surface facing the locking protrusion of the handle when the detergent supply device is in the locked state, and a first inclined surface connected to the first vertical surface and having a slope ascending toward a front side of the fixing protrusion.

9. The washing machine of claim 1, further comprising:

a pair of locking protrusions, wherein the pair of locking protrusions are configured to protrude in opposite directions to each other from both sides of the handle.

10. The washing machine of claim 1, wherein the locking protrusion includes a second vertical surface facing the fixing protrusion of the control panel when the detergent supply device is in the locked state, and a second inclined surface connected to the second vertical surface and having a slope descending toward a rear side of the locking protrusion.

11. The washing machine of claim 1, wherein the detergent supply device has a hinged structure which rotatably connects the handle to the body.

12. The washing machine of claim 1, wherein the detergent supply device has a plurality of link bars connecting the body and the handle such that the handle is rotatable about two different axes provided in the body.

13. The washing machine of claim 1, wherein the detergent supply device has a slide structure to guide rotation of the handle through two pairs of holes providing different paths provided in the body.

14. The washing machine of claim 11, wherein the detergent supply device includes an elastic member arranged to surround a rotation axis of the handle.

15. The washing machine of claim 11, wherein the detergent supply device includes an elastic member connecting the body with at least one of an upper portion of the handle and a lower portion of the handle.

16. A washing machine, comprising:

a housing;

a control panel on a front surface of the housing and having an opening; and a detergent supply device configured to be drawn into and out of the washing machine through the opening, the detergent supply device including:

a body to accommodate a detergent therein, and a handle having a front surface alignable with the front surface of the housing, a back surface opposite the front surface, and a grip portion on one side of the back surface that is concealed from an outside of the control panel when the handle is aligned with the front surface of the housing, wherein the handle is rotatable to no longer be aligned with the front surface of the housing and to move the grip portion to no longer be concealed from the outside when the front surface of the handle is not aligned with the front surface of the housing.

17. The washing machine of claim 16, wherein the handle includes a first end including the grip portion, and a second end opposite the first end, wherein the handle is configured to rotate such that the second end approaches the body and the first end moves away from the body.

18. A washing machine, comprising:

a housing;

a control panel on a front surface of the housing and having an opening; and a detergent supply device configured to be drawn into and out of the washing machine through the opening, the detergent supply device including:

a body to accommodate a detergent therein, and a handle having a front surface alignable with a front surface of the housing, a back surface opposite the front surface, and a grip portion inside the opening and on one side of the back surface so as to be concealed from an outside of the control panel when the handle is aligned with the front surface of the housing, wherein the handle is rotatable to no longer be aligned with the front surface of the housing and to move the grip portion to no longer be concealed from the outside when the front surface of the handle is not aligned with the front surface of the housing.

19. The washing machine of claim 16, wherein the handle is rotatable about a rotating portion vertically between a first end of the handle and a second end of the handle.

20. The washing machine of claim 1, wherein the handle is rotatably connected to the body at a rotating portion vertically between a top end of the handle and a bottom end of the handle.

* * * * *